US006761232B2

(12) United States Patent
Moody et al.

(10) Patent No.: US 6,761,232 B2
(45) Date of Patent: Jul. 13, 2004

(54) SPRUNG MEMBER AND ACTUATOR FOR DOWNHOLE TOOLS

(75) Inventors: Michael J. Moody, Katy, TX (US); William C. Paluch, Jersey Village, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 0 days.

(21) Appl. No.: 10/292,301

(22) Filed: Nov. 11, 2002

(65) Prior Publication Data

US 2004/0089477 A1 May 13, 2004

(51) Int. Cl.[7] ..... E21B 7/04
(52) U.S. Cl. ..... 175/61; 175/73
(58) Field of Search ..... 175/61, 73; 166/212, 166/214

(56) References Cited

U.S. PATENT DOCUMENTS

| | | | | | |
|---|---|---|---|---|---|
| 2,373,880 | A | * | 4/1945 | Driscoll | 166/208 |
| 2,603,163 | A | * | 7/1952 | Nixon | 166/212 |
| 2,874,783 | A | * | 2/1959 | Haines | 166/212 |
| 2,880,805 | A | * | 4/1959 | Nelson et al. | 166/120 |
| 2,915,011 | A | * | 12/1959 | Hamill | 175/4.52 |
| 4,407,374 | A | | 10/1983 | Wallussek et al. | |
| 4,416,339 | A | * | 11/1983 | Baker et al. | 175/61 |
| 4,463,814 | A | | 8/1984 | Horstmeyer et al. | |
| 4,844,178 | A | | 7/1989 | Cendre et al. | |
| 4,947,944 | A | | 8/1990 | Coltman et al. | |
| 4,957,173 | A | * | 9/1990 | Kinnan | 175/61 |
| 5,070,950 | A | | 12/1991 | Cendre et al. | |
| 5,603,386 | A | | 2/1997 | Webster | |
| 5,797,453 | A | | 8/1998 | Hisaw | |
| 5,941,323 | A | | 8/1999 | Warren | |
| 6,148,933 | A | | 11/2000 | Hay et al. | |
| 6,158,529 | A | | 12/2000 | Dorel | |
| 6,290,003 | B1 | | 9/2001 | Russell | |
| 6,427,783 | B2 | | 8/2002 | Krueger et al. | |

FOREIGN PATENT DOCUMENTS

| | | | |
|---|---|---|---|
| EP | 1174582 | A3 | 1/2002 |
| WO | WO-01-51761 | A1 | 7/2001 |
| WO | WO-03-097989 | A1 | 11/2003 |

* cited by examiner

*Primary Examiner*—Hoang Dang

(57) ABSTRACT

A downhole tool for use in a well bore is provided. The tool includes a tool body and at least one elongated sprung member deployed on an outer surface thereof. The sprung member is configured to lie in a rest position substantially parallel to the outer surface and further includes at least one movable end that is movable with respect to the tool body. The tool further includes an actuation module deployed on the tool body. The actuation module is operably engaged with the sprung member, and disposed, upon actuation, to deflect said movable end thereof away from the rest position. Displacement of the movable end of the sprung member causes elastic spring biasing of the sprung member via bending thereof. The biasing urges the sprung member to return to the rest position upon de-actuation of the actuation module.

38 Claims, 4 Drawing Sheets

SPRUNG MEMBER AND ACTUATOR FOR DOWNHOLE TOOLS

FIELD OF THE INVENTION

The present invention relates generally to the drilling of oil and gas wells, and more specifically, to downhole tools including one or more force application members for centering, positioning, stabilizing, and/or steering downhole tools such as a directional drilling assembly in a well bore.

BACKGROUND OF THE INVENTION

During the drilling, testing, and completion of oil and gas wells numerous downhole tools are used that utilize radially protruding members that contact the well bore wall to center, position, stabilize, and/or steer the tool in the well bore. For example, in directional drilling applications, which are commonly used to more fully exploit hydrocarbon reservoirs, drill assemblies are typically utilized that include a plurality of independently operable force application members to apply force on the well bore wall during drilling to maintain the drill bit along a prescribed path and to alter the drilling direction. Such force application members are typically disposed on the outer periphery of the drilling assembly body or on a non-rotating sleeve disposed around a rotating drive shaft. One or more of the force application members may be moved in a radial direction, e.g., using electrical or hydraulic devices, to apply force on the well bore wall in order to steer the drill bit outward from the central axis of the well bore.

Prior art downhole tools, such as the Autotrak® steering tool (available from Baker Hughes Incorporated, Houston, Tex.), typically utilize force application members that are coupled to the tool body at a hinge or pivot. Alternately, such as in the steering tool disclosed by Webster (U.S. Pat. No. 5,603,386), the force application members are not directly coupled to the tool body, but rather to one or more actuators that are in turn mounted on the tool body.

Downhole tools that include force application members typically are further capable of retracting the members inward towards the tool body. Such retraction may be required, for example, at the end of an operation, such as a drilling or survey operation, to allow the tool to be withdrawn from the well bore without becoming lodged therein or damaging the force application members. One drawback with the above described prior art downhole tools, is that they tend to require complex mechanical and/or pneumatic/hydraulic devices for extending and retracting the force application members. Such mechanisms for extending and retracting typically have a number of interoperable moving parts, whose complexity tends to inherently reduce the reliability of the downhole tool. Further, increased complexity tends to increase both fabrication and maintenance costs.

Therefore, there exists a need for downhole tools including improved force application members and/or force application modules. In particular, there exists a need for downhole tools including relatively simple (and therefore relatively inexpensive) force application member mechanisms.

SUMMARY OF THE INVENTION

In one aspect this invention includes a downhole tool. The downhole tool includes a tool body and at least one elongated sprung member deployed on an outer surface of the tool body. The sprung member is configured to lie in a rest position substantially parallel to the outer surface. Further, each sprung member includes at least one movable end, which is movable with respect to the tool body. Displacement of the movable end with respect to the tool body causes elastic spring biasing of the sprung member via bending thereof. The downhole tool further includes an actuation module deployed on the tool body, operably engaged with the sprung member, and disposed, upon actuation, to deflect the movable end thereof away from the rest position. The elastic spring biasing urges the sprung member to return to the rest position upon de-actuation of the actuation module. In one variation, the downhole tool is a steering tool for a directional drilling assembly and includes at least three sprung members disposed equi-angularly about the periphery of the tool.

In another aspect this invention includes a method for deflecting a downhole tool in a direction substantially orthogonal to a cylindrical axis of a well bore. The method includes providing a downhole tool as described in the preceding paragraph and lowering the tool into a well bore. The method further includes causing the actuation module to deflect the movable end of the sprung member away from the rest position and into engagement with a wall of the well bore, and de-actuating the actuation module so as to allow the elastic spring biasing to urge the sprung member to return towards the rest position and away from the wall of the well bore.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should be also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The present invention addresses one or more of the above-described drawbacks in downhole tools. Referring briefly to the accompanying figures, this invention includes a tool for use in downhole applications. The downhole tool includes at least one spring-like, elastically deformable, force application member, also referred to as a sprung member in this disclosure, disposed on the tool body preferably in a rest position when in a retracted state. In order to extend the sprung member outward from the tool body into surface-to-surface engagement with a surrounding surface (such as the wall of a well bore), an actuation module exerts a force thereon. When extended, the sprung member is elastically biased such that upon removal of the force, the sprung member retracts in a spring-like fashion. In one embodiment, the downhole tool of this invention includes a three-dimensional steering tool for use in directional drilling applications and includes at least three independently operable sprung members distributed substantially equi-angularly around the periphery thereof.

Exemplary embodiments of the present invention advantageously provide a downhole tool including a single mechanism for selectively extending and retracting a force application member used for centering, positioning, stabilizing, and/or steering the downhole tool in a well bore. Tools embodying this invention may thus display improved reliability as a result of a reduction in complexity over the prior art. Furthermore, a reduction in complexity tends to reduce both fabrication and maintenance costs. These and other advantages of this invention will become evident in light of the following discussion of various embodiments thereof.

Figure 1A:
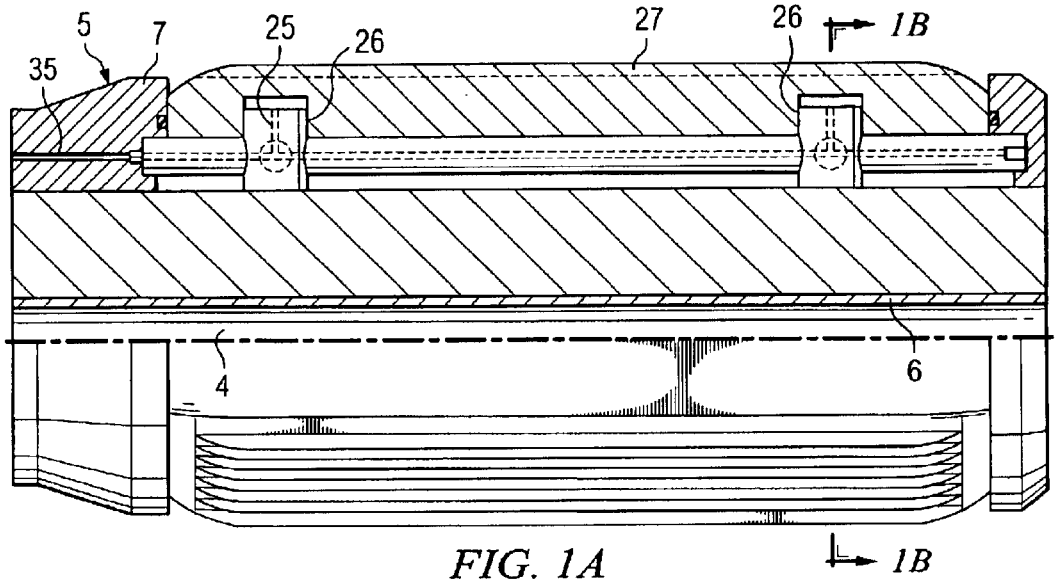
FIG. 1A (PRIOR ART)
FIG. 1A is a partial cross-sectional longitudinal view of a portion of a prior art downhole steering tool for directional drilling.
Figure 1B:
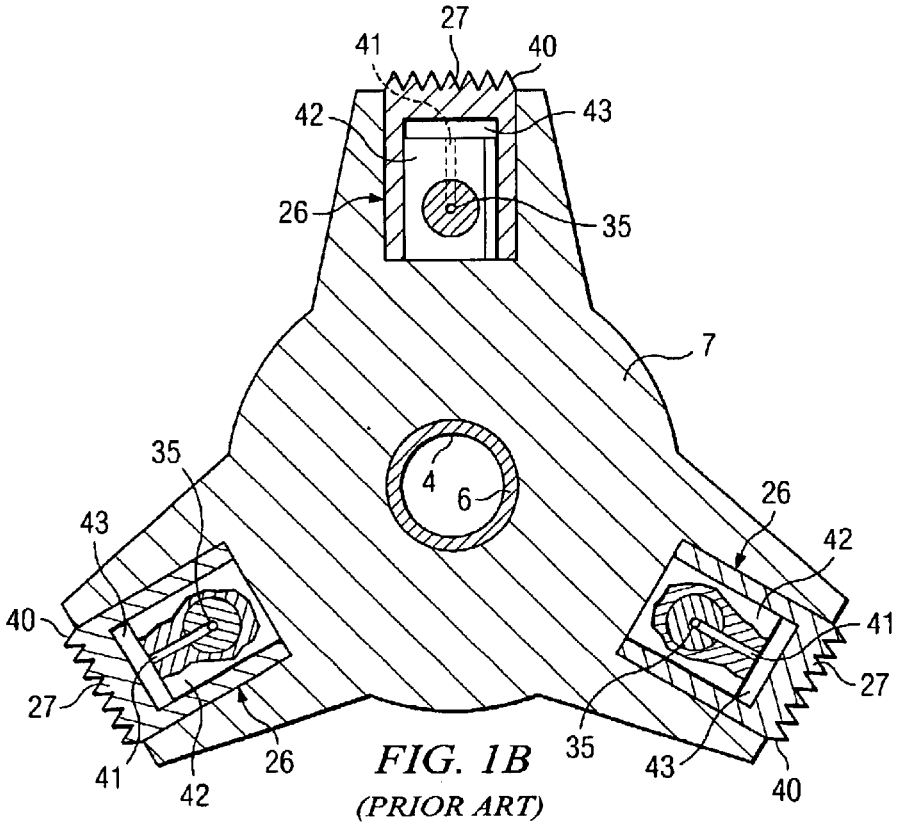
FIG. 1B (PRIOR ART)
FIG. 1B is a cross-sectional view along line 1B—1B of FIG. 1A.

Referring now to FIGS. 1A and 1B, a portion of one example of a prior art steering tool for directional drilling is illustrated (FIGS. 1A and 1B abstracted from U.S. Pat. No. 5,603,386, hereafter referred to as the Webster patent). The Webster patent discloses a steering/stabilizing tool including a body portion 5 having a central bore 4. The tool further includes a number of force application members 27 (referred to as "blades" in the Webster patent, of which only one is shown in FIG. 1A) disposed circumferentially around an inner sleeve 6 extending through an outer sleeve 7. In a preferred embodiment of the Webster patent, three parallel force application members 27 are disposed equi-angularly around the circumference of the tool (see FIG. 1B). A valve body (not shown) is operated by hydraulic switches, which act on instructions from a control unit to open and close hydraulic lines 35 which communicate with the force application members 27.

Piston assemblies 26 (or other suitable equivalents) are provided for extending and retracting the force application members 27. A potentiometer 25, or an ultrasonic measuring device, or other suitable measuring device, is provided for each piston assembly to calculate the displacement of each of the force application members 27 from the retracted position. Each of the force application members 27 may be independently extendible and retractable to retain the steering/stabilizing tool at the desired eccentricity relative to the central axis of the well bore.

The piston assemblies 26 and force application members 27 of a preferred embodiment of the Webster patent are shown more clearly in FIG. 1B. The preferred arrangement of the three parallel force application members 27 is shown, and the force application members 27 may be provided with longitudinally serrated outer edges 40 which may enable the tool to grip the edges of the well bore more effectively. Each hydraulic line 35 communicates with a force application member 27 via a port 41 through the piston 42 in each assembly 26. Thus, when hydraulic pressure changes are transmitted from the valve body (not shown) along a hydraulic line 35, these pressure changes are passed through port 41 and into chamber 43 between a piston 42 and the force application member 27. The piston 42 remains stationary, and the force application member 27 is extended or retracted in response to theses pressure changes.

It will be understood that the steering tool disclosed in the Webster patent is characteristic of other tools of the prior art providing force application members, in that it requires a complex mechanism for extending and retracting the force application members. The Webster patent, for example, discloses a complex hybrid mechanical/hydraulic mechanism, the mechanism having many interoperable moving parts and including a hydraulic circuit including eight solenoids and nine check valves for controlling three force application members. Such complex mechanisms for extending and retracting tend to reduce the reliability of the downhole tool. Further, increased complexity tends to increase both fabrication and maintenance costs.

Figure 2:
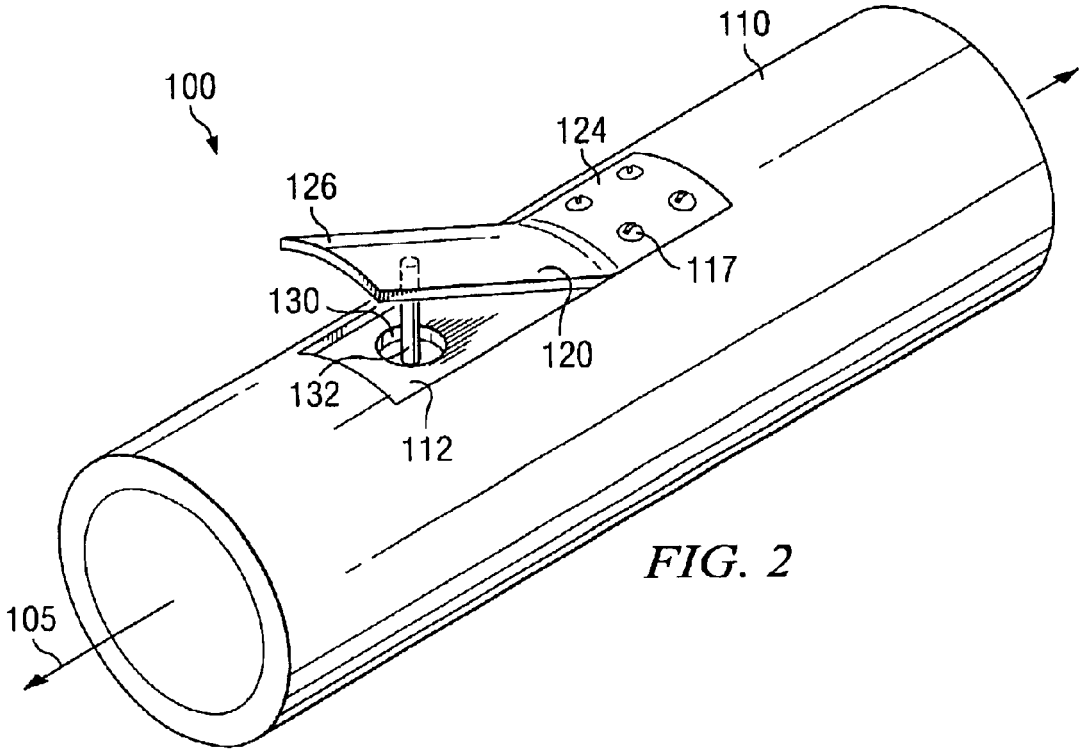
FIG. 2 is schematic representation, perspective view, of a portion of one embodiment of a downhole tool of the present invention.

Referring now to FIGS. 2 through 6, exemplary embodiments of the present invention are illustrated. FIG. 2 illustrates a schematic representation, perspective view, of a portion of one embodiment of a cylindrical downhole tool 100 upon which this invention may be deployed, typically in deep well applications. In the embodiment of FIG. 2, tool 100 includes a substantially cylindrical tool body 110, having at least one sprung member 120 disposed thereon. Sprung member 120 is fabricated from an elastically biasable material (such as spring steel). While FIG. 2 illustrates a fixed end 124 of sprung member 120 fastened to tool body 110 by one or more screws 117, it will be appreciated by those of ordinary skill in the art that fixed end 124 of sprung member 120 may be integral with tool body 110, or alternatively coupled thereto using other suitable attachment arrangements such as other types of fasteners (bolts, rivets, wedges, etc.), adhesive, clamps, or welding, brazing or the like. Downhole tool 100 further includes at least one actuation module 130 operably engaged with the sprung member 120.

Figure 3A:
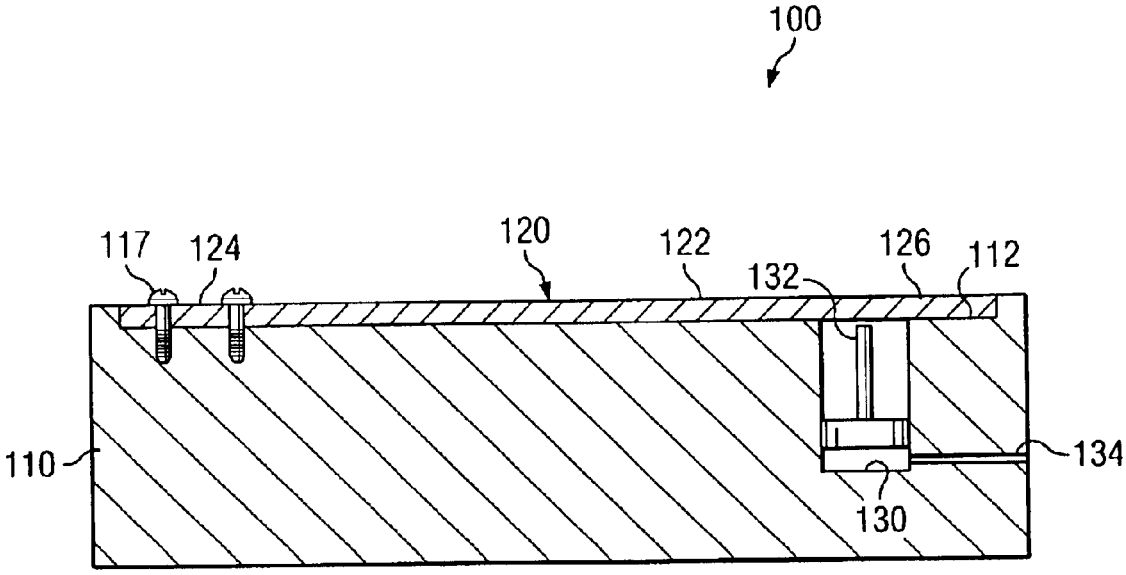
FIG. 3A is a cross-sectional schematic representation of a portion of the embodiment shown in FIG. 2.
Figure 3B:
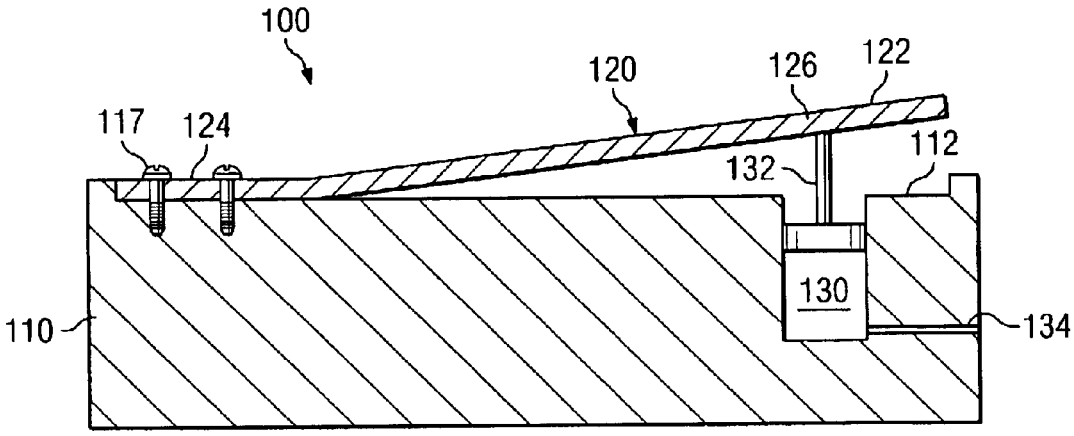
FIG. 3B is a cross-sectional schematic representation of the tool of FIG. 3A showing an extended sprung member.

Referring now also to FIGS. 3A and 3B, which illustrate a cross-sectional schematic representation of a portion of the embodiment of FIG. 2, sprung member 120 is a spring-like member disposed, for example, in a recess 112 in the tool body 110. In the retracted position (as shown in FIG. 3A), the sprung member 120 is typically disposed in a rest position substantially parallel to an outer surface (the periphery) of the tool body 110 and relatively close to, or alternatively recessed, therein. In the embodiments shown on FIGS. 2, 3A, and 3B, sprung member 120 is substantially in elastic spring equilibrium when in its rest position. In order to extend the sprung member 120, the actuation module 130 exerts a force over a desired actuation distance in a substantially radial direction (e.g., in a substantially perpendicular direction to the central axis of the well bore). When extended (either fully or partially), the sprung member 120 is deflected away from and elastically spring biased towards its rest position (such deflection illustrated in FIG. 3B). Upon removal of the force via retraction of the actuation module 130 towards its own rest position, the sprung member 120 also retracts. As shown in FIGS. 2, 3A and 3B and noted above, the sprung member 120 typically includes a fixed end 124 and a moving end 126. As noted, although FIGS. 2, 3A, and 3B illustrate a sprung member 120 screwed to tool body 110 at fixed end 124, it will be understood that fixed end 124 may be coupled to the tool body 110 by any suitable attachment arrangement, such as by fasteners including bolts, screws, rivets, wedges, and the like, or by adhesive, or by clamps, or by brazing or welding, or the like. Alternatively, in one embodiment fixed end 124 may be integral with the tool body 110 or with an annular sleeve disposed around the tool body 110 (such as illustrated with reference to FIG. 6, for example, described in more detail below). Additionally, the artisan of ordinary skill will readily recognize that the sprung member 120 may be coupled to the tool body 110 at or near the center of the sprung member 120 and that both ends 124 and 126 may be moveable with respect to the tool body. Nevertheless, in the embodiment shown, actuation module 130 urges the moving end 126 of sprung member 120 substantially radially outward from tool body 110 (in a direction substantially orthogonal to the cylindrical axis of the well bore) preferably into contact with a surface (such as a well bore wall) from which it is desired to push the tool body 110 away (or against which to stabilize the tool body 110), while fixed end 124 remains coupled to (or integral with) the tool body 110. The sprung member 120 is thus elastically spring biased (e.g., deflected out of its equilibrium shape as shown in FIG. 3B) by actuation module 130. It will be appreciated that consistent with the present invention, sprung member 120 may be extended outward to substantially any displacement up to the yield point of the material of which it is made. Embodiments of the present invention may deploy and/or configure the actuation module 130 so as to prevent the sprung member 120 from being extended beyond its yield point. For example, an actuation module 130 with a limited range of motion may be utilized, thus limiting the degree to which it may extend sprung member 120. Alternatively, actuation module 130 may be sufficiently recessed in the tool body 110 to limit the degree to which it may extend sprung member 120. The tool 100 may alternatively and/or additionally include one or more constraining elements (not shown), such as a sleeve, for preventing over-extension of the sprung member(s) 120.

While some embodiments of the present invention include only a single sprung member 120, other embodiments include two or more, and advantageously at least three independently extendible and retractable sprung members 120 to provide optimally controllable stabilization eccentric displacement within, for example, a well bore. Further, downhole tool 100 optimally includes one or more distinct, substantially self-contained contained actuation modules 130 operably engaged with a corresponding sprung member 120 (e.g., a downhole steering tool typically includes three sprung members 120 each independently operable by the action of a corresponding actuation module 130). However, in other embodiments, such as on a stabilizing tool or a wire or slick line testing tool, it may be desirable to configure two or more sprung members 120 to be actuated by a single actuation module 130. It will be appreciated that the present invention is not limited to the number of sprung members 120 that may be deployed on a tool, nor to the number of actuation modules that may operably engage with such sprung members, either alone or in combination.

It will be further appreciated that the invention is not limited to the orientation of sprung member 120 or its orientation on a tool. Further alternative embodiments may include sprung members 120 deployed towards the drill bit end of a tool, and/or towards the tool end away from the drill bit. Still further alternative embodiments may include sprung members in which the fixed end 124 thereof is deployed towards the end of the tool proximate to the drill bit, and/or towards the tool end distal from the drill bit. In other embodiments, the orientation of sprung member 120 need not be substantially parallel with the cylindrical axis 105 of the tool (such parallel deployment illustrated in exemplary fashion on FIG. 2), but may also be oriented in any plane, including substantially perpendicular to the cylindrical axis 105. It will be understood that the invention is not limited in any of these regards. In operation, however, there may be a preferred orientation for some applications and sprung member configurations. For example, in an application in which a downhole tool is to be held in a stationary position relative to a well bore wall, sprung members 120 being oriented substantially orthogonally to the cylindrical axis 105 of the tool may be desirable in that they may provide for a greater contact area between the sprung member 120 and the well bore wall.

In embodiments deployed in drilling applications, there may be relatively large forces (perhaps up to about 5 metric tons) exerted between the sprung member 120 and the wall of the well bore. In such cases, it may be desirable to include a wear resistant layer or material, such as a hard facing, a hardened weld layer, or a bolt on device, on the outer surface 122 of the sprung member 120. It may also be desirable to serrate the outer surface 122 of the sprung member 120, which may enable the sprung member 120 to grip the wall of the well bore more effectively. Although these aspects are not specifically illustrated, they are considered to be understood by those of skill in the art.

Actuation module 130 may include substantially any actuating device, such as an electric motor or screw drive, wedges, bladders, hydraulic or pneumatic cylinders (or pistons), and/or other devices known to those skilled in the art. Embodiments including hydraulic cylinders (such as that shown in FIGS. 3A and 3B) tend to be particularly serviceable. As described in the Webster patent, the hydraulic cylinders may be controlled by hydraulic switches (not shown), which may act on instruction from a control module (not shown) to open and close hydraulic lines 134. Thus hydraulic pressure changes are transmitted to the sprung members 120 through the hydraulic cylinder 130 and an actuating arm 132. The hydraulic fluid may be pressurized by substantially any known system, such as an electric powered pump or alternatively by a turbine driven by a flow of drilling fluid through the core of the tool.

As described hereinabove, downhole tool 100 may include substantially any tool used downhole in the drilling, testing, and/or completion of oilfield wells, although the invention is expressly not limited in this regard. For example, downhole tool 100 may include a three dimensional steering assembly for use in directional drilling, similar to that disclosed in the Webster patent and as shown on FIGS. 1A and 1B of this disclosure, in which the force application members 27 of the steering assembly (referred to by Webster as a "variable stabilizer") operate to apply a lateral force and displacement to the drill string in order to deflect it from the central axis of the well bore and thus change the drilling direction. In such a configuration, the tool body 110 is substantially non-rotational (e.g., a non-rotational sleeve) relative to the well bore during the drilling operation. Downhole tool 100 thus may incorporate one or more bearing assemblies that enable the tool body 110 and a rotational drive portion of the drill string (for example that extends through a central bore in the tool body) to rotate relative to one another. Downhole tool 100 may be configured for mounting on a drill string and thus include conventional threaded or other known connectors on the top and bottom thereof. During a directional drilling operation downhole tool 100 is typically coupled to the drill string about 0.5 to about 10 meters from the drill bit, although once again, the invention is expressly not limited in this regard.

A downhole tool 100 deploying this invention may further include sensors, timers, programmable processors, and the like for sensing and/or controlling the relative positions of the sprung members 120. These may include substantially any devices known to those skilled in the art, such as those disclosed in the Webster patent or in U.S. Pat. No. 6,427,783 to Krueger et al. For example, when downhole tool 100 is a steering tool, these sensors and electronics may enable bore holes having a pre-programmed profile, such as a dogleg, to be drilled from the start to the end of a borehole section.

Other exemplary embodiments of the invention may include downhole tools 100 in the form of a conventional slick line or wire line assembly, in fishing tools, or in a string of downhole tools including for example, a drill string, logging while drilling tools, measurement while drilling tools, formation testing tools, drill stem testing tools, downhole cementing tools, and the like. Exemplary measurement while drilling tools include sonic formation measurement tools, radioactive formation measurement tools, electromagnetic wave formation measurement tools, drilling formation testing and sampling tools, and the like.

Figure 4:
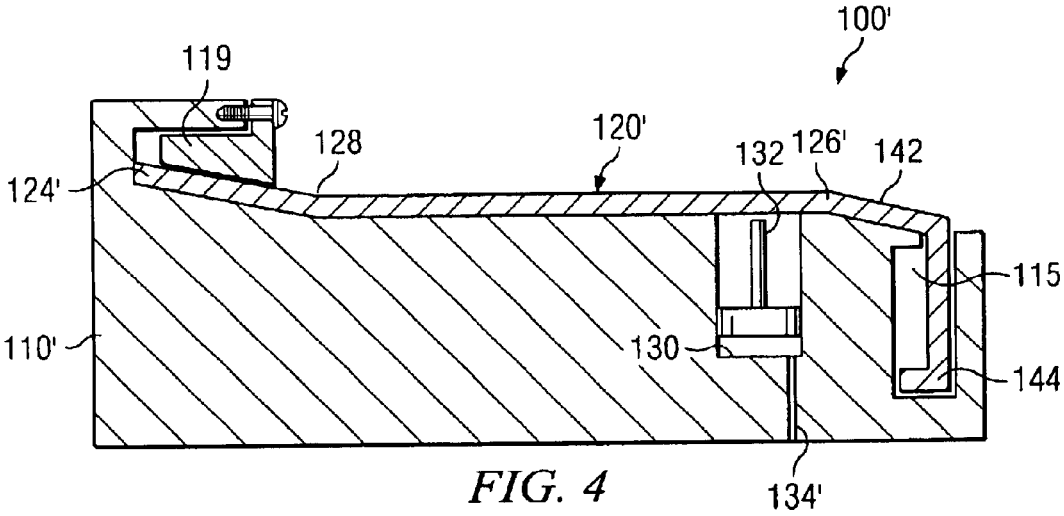
FIG. 4 is a cross-sectional schematic representation of a portion of an alternate embodiment of a downhole tool of this invention.

Referring now to FIG. 4, further alternate embodiments of this invention are illustrated. Downhole tool 100' is similar to the downhole tool 100 illustrated in FIGS. 2, 3A, and 3B, in that it includes a tool body 110' with a spring-like, sprung member 120' disposed thereon. Sprung member 120', as with sprung member 120 in FIGS. 2, 3A, and 3B, is fabricated from an elastically biasable material such as a conventional spring steel, and may further be integral with tool body 110' or coupled thereto at a fixed end 124'. In the embodiment shown in FIG. 4, a frictional coupling, such as a wedge 119, is utilized to couple the sprung member 120' to the tool body 110'. Sprung member 120' differs from sprung member 120 in FIGS. 2, 3A, and 3B in that a sloped portion 142 of free end 126' is inclined inward towards the tool body 110'. When an embodiment of the invention including sprung member 120' and sloped portion 142 is deployed, for example, in a directional drilling tool, sloped portion 142 may reduce the likelihood of the sprung member 120' being hung up on protrusions (or other non-uniformities) on the well bore wall. Sloped portion 142 may also facilitate retraction of the sprung member 120' when the tool 100' enters a reduced area bore. In the embodiment illustrated on FIG. 4, sprung member 120' further includes a hook 144 at free end 126' for engaging a corresponding recess 115 in the tool body 110'. The hook 144 and corresponding recess 115 provide for a limited range of motion of the free end 126' of the sprung member 120', thus keeping the free end 126' engaged with the tool body 110' and reducing the chance of damage to or loss of the sprung member 120' downhole, for example, when the tool 100' is moved. Hook 144 also limits the extent to which the sprung member 120' may be extended and thus may prevent it from being extended beyond its yield point by the actuation module 130. Sprung member 120' may further be pre-biased towards the tool body 110 when in the fully retracted (or rest) position, as shown in FIG. 4 at bend 128. The artisan of ordinary skill will readily recognize that pre-biasing may also be achieved by utilizing a curved (e.g., arc shaped) sprung member 120' and pressing the concave side of the sprung member 120' substantially flat against the toot body 110' while coupling thereto. Utilizing a curved sprung member may be advantageous in that it tends to simplify fabrication of the tool body. Such pre-biasing of sprung member 120' provides for substantially full retraction thereof and further provides a retention force for holding the sprung member 120' in the retracted position.

Figure 5A:
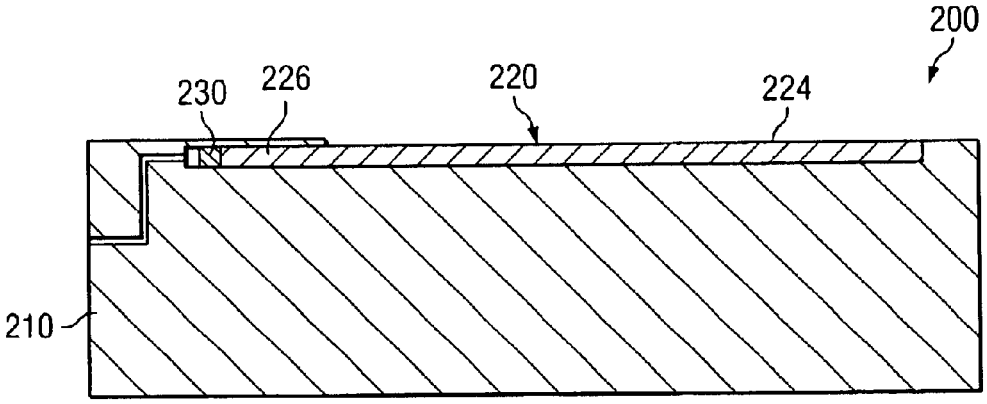
FIG. 5A is a cross-sectional schematic representation of a portion of another alternate embodiment of a downhole tool of this invention.
Figure 5B:
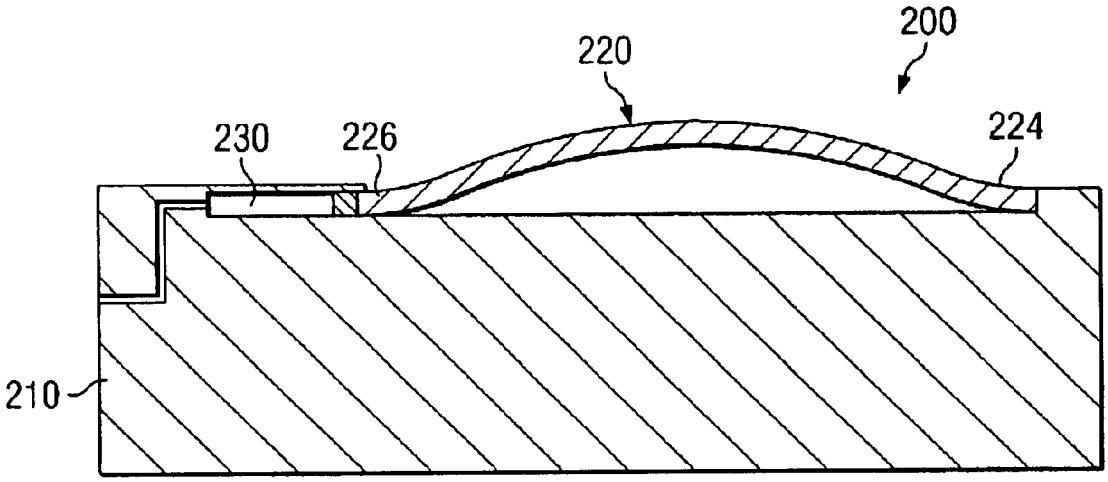
FIG. 5B is a cross-sectional schematic representation of the tool of FIG. 5A showing an extended sprung member.

Referring now to FIGS. 5A and 5B, yet further alternative embodiments of this invention are illustrated. Downhole tool 200 is similar to the downhole tool 100 illustrated on FIGS. 2, 3A and 3B, in that it includes a tool body 210 with a spring-like, sprung member 220 disposed thereon. Sprung member 220, as with sprung member 120 on FIGS. 2, 3A and 3B, is fabricated from an elastically biasable spring material such as a conventional spring steel, and in one embodiment may further be integral with tool body 210 or coupled thereto at end 224. Downhole tool 200 differs from tool 100 in that actuation module 230 urges movable end 226 in a direction substantially parallel to the surface of the tool body 210 (rather than orthogonal thereto as in tool 100). This results in an elastic outward bowing-like deformation of sprung member 220 into contact with a surface against which it is desired to push or stabilize tool 200, such as a well bore wall, as illustrated in FIG. 5B. Upon retraction of actuation module 230, sprung member 220 retracts back towards tool body 210 as illustrated in FIG. 5A. Further, the artisan of ordinary skill will readily recognize that end 224 may be moveable and operably engaged with a further actuation module (not shown) extending in a direction substantially opposing actuation module 230, such that upon actuation of both actuation modules, ends 224 and 226 are urged towards one another so as to cause a bow away from the tool body 210, both ends moving with respect to the tool body 210.

Figure 6:
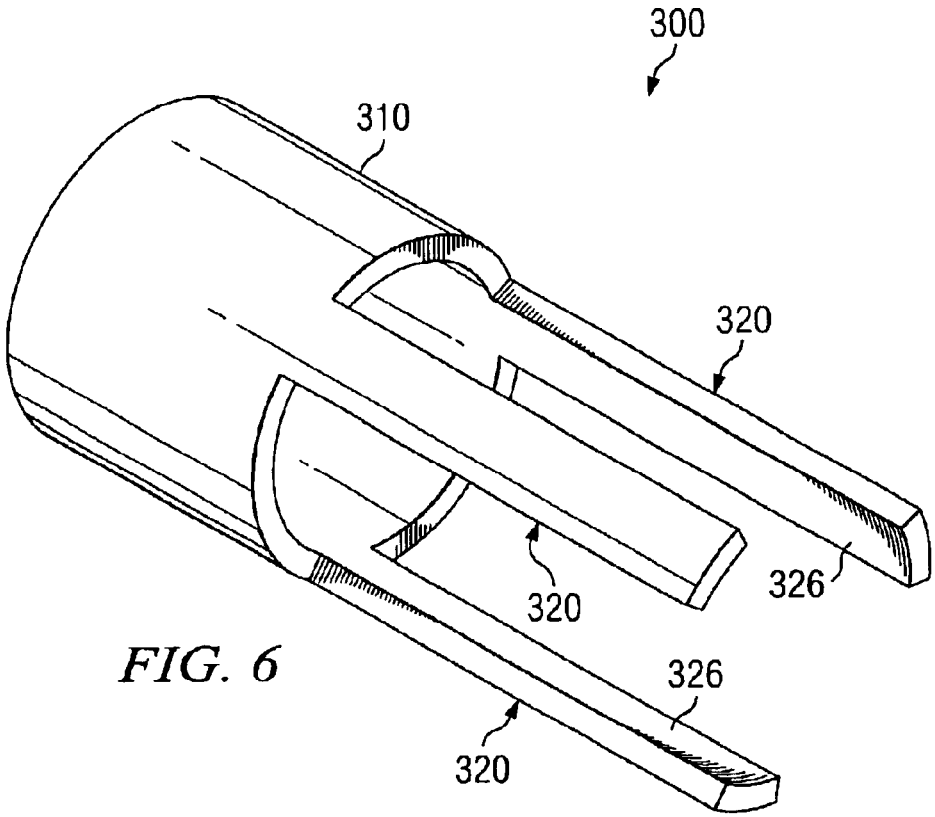
FIG. 6 is a schematic representation, perspective view, of a portion of yet another alternate embodiment of a downhole tool of this invention.

Referring now to FIG. 6, a sprung member module 300 in the form of an annular ring 310 having longitudinally extending integral sprung members 320 is illustrated. Sprung member module 300 is configured for mounting on a downhole tool, such as a three dimensional steering tool for directional drilling. Sprung member module 300 is typically mounted with the movable ends 326 of the sprung members 320 operably engaged with actuation modules (not shown) disposed in the downhole tool (not shown). The actuation modules may be configured to urge the movable ends 326 of the sprung members 320 in substantially any direction, but are typically configured to urge them in either a direction orthogonal to the surface of the tool (as in FIGS. 2, 3A and 3B), or in a direction parallel to the surface of the tool (as in FIGS. 5A and 5B).

Tools including embodiments of the sprung member assembly described herein may be useful in one or more downhole applications. For example, embodiments of the sprung member assembly of this invention may be useful for deflecting a downhole tool eccentrically from the cylindrical axis of a well bore (i.e., away from the geometrical center of the well bore). Deflection of the tool is caused by actuation of the actuation module to deflect a movable end of the sprung member away from the rest position, thereby causing the sprung member to engage a wall of the well bore. De-actuation of the actuation module allows the elastic spring biasing to urge the sprung member to return towards the rest position and away from the wall of the well bore. In another example, embodiments of the sprung member assembly of this invention may be useful for changing the drilling direction of a drilling assembly in a well bore. Changing of the drilling direction is caused by actuation of the actuation module to deflect the movable end of the sprung member away from the rest position, thereby deflecting the sprung member into engagement with a wall of the well bore. Such engagement with the wall of the well bore alters the eccentricity of the of the steering tool from a cylindrical axis of the well bore, which tends to alter an angle of approach of a drill bit included in the drilling assembly. De-actuating the actuation module allows the elastic spring biasing to urge the sprung member to return to the rest position away from the wall of the well bore, thus also altering the eccentricity of the steering tool from the cylindrical axis of the well bore.

Although the present invention and its advantages have been described in detail, it should be understood that various changes, substitutions and alternations can be made herein without departing from the spirit and scope of the invention as defined by the appended claims.

We claim:

1. A downhole steering tool comprising;

a steering tool body having an outer surface;

at least one elongated sprung member deployed on said outer surface of said tool body and configured to lie in a rest position substantially parallel to said outer surface;

said sprung member further having at least one movable end, said movable end being movable with respect to said tool body, wherein displacement of said movable end with respect to said tool body causes elastic spring biasing of said sprung member via bending thereof; and an actuation module deployed on said tool body, the actuation module operably engaged with said sprung member, and disposed, upon actuation, to deflect said movable end thereof away from the rest position;

wherein said elastic spring biasing urges said sprung member to return to the rest position upon de-actuation of said actuation module.

2. The downhole tool of claim 1, wherein said sprung member further comprises a fixed end, said fixed end being fixed to said tool body, said movable end being movable with respect to said fixed end.

3. The downhole tool of claim 1, wherein said sprung member comprises two movable ends.

4. The downhole tool of claim 3, wherein said sprung member further comprises a fixed portion, the fixed portion being fixed to the tool body and located between the movable ends.

5. The downhole tool of claim 1, wherein said actuation module is disposed to deflect said movable end into engagement with a well bore wall.

6. The downhole tool of claim 1 being coupled to a wire line apparatus.

7. The downhole tool of claim 1 being coupled to a drill string.

8. The downhole tool of claim 1, wherein said sprung member is coupled to said tool body.

9. The downhole tool of claim 8, wherein a frictional coupling is used to couple said sprung member to said tool body.

10. The downhole tool of claim 1, wherein said sprung member is integral with said tool body.

11. The downhole tool of claim 1, wherein said sprung member is fabricated from spring steel.

12. The downhole tool of claim 1, wherein said sprung member is disposed in a recess in said tool body.

13. The downhole tool of claim 1, wherein said movable end of said sprung member includes a sloped portion inclined inward towards said tool body.

14. The downhole tool of claim 1, wherein said movable end of said sprung member includes a hook-like portion configured to engage a corresponding recess in said tool body.

15. The downhole tool of claim 14, wherein said engagement of said hook-like portion with said corresponding recess limits the range of motion of said movable end of said sprung member.

16. The downhole tool of claim 14, wherein said engagement of said hook-like portion with said corresponding recess prevents said sprung member from being extended beyond its yield point.

17. The downhole tool of claim 1, wherein said sprung member is pre-biased in said rest position towards said tool body.

18. The downhole tool of claim 1, wherein said sprung member further comprises a wear resistant outer layer.

19. The downhole tool of claim 1, wherein said sprung member further comprises a serrated outer edge for engaging a well bore wall.

20. The downhole tool of claim 1, wherein said actuation module comprises a hydraulic cylinder.

21. The downhole tool of claim 20, wherein said hydraulic cylinder further comprises an actuating arm operably engaged with said movable end of said sprung member.

22. The downhole tool of claim 1, wherein said actuation module is disposed to urge said movable end of said sprung member in a direction substantially orthogonal to a cylindrical axis of a well bore.

23. The downhole tool of claim 1, wherein said actuation module is disposed to urge said movable end of said sprung member in a direction substantially parallel to a cylindrical axis of a well bore.

24. The downhole tool of claim 1, wherein said fixed end of said sprung member is integral with an annular ring encircling said tool body, said annular ring further fixed to said tool body.

25. A sprung member assembly for a downhole steering tool, said sprung member assembly comprising:

an elongated sprung member deployed on an outer surface of a steering tool body and configured to lie in a rest position substantially parallel to said outer surface;

said sprung member further having at least one movable end, said movable end being movable with respect to said tool body, wherein displacement of said movable end with respect to said tool body causes elastic spring biasing of the sprung member via bending thereof; and an actuation module deployed on said tool body, said actuation module operably engaged with said sprung member, and disposed, upon actuation, to deflect the movable end thereof away from the rest position;

wherein the elastic spring biasing urges said sprung member to return to the rest position upon de-actuation of said actuation module.

26. The sprung member assembly of claim 25, wherein actuation of said actuation module deflects said movable end into engagement with a well bore wall.

27. A steering tool for use in a steerable drilling assembly, said steering tool comprising;

a steering tool body disposed to be included in a drill string, the tool body having an outer surface;

at least one elongated sprung member deployed on said outer surface of said tool body and configured to lie in a rest position substantially parallel with said outer surface;

said sprung member further having at least one movable end, said movable end being movable with respect to said tool body, wherein displacement of said movable end with respect to said tool body causes elastic spring biasing of said sprung member via bending thereof; and an actuation module deployed on said tool body, the actuation module operably engaged with said sprung member, and disposed, upon actuation, to deflect the movable end thereof away from the rest position;

wherein the elastic spring biasing urges said sprung member to return to the rest position upon de-actuation of said actuation module.

28. The steering tool of claim 27, further comprising at least three sprung members each having a movable end disposed to be independently deflected from the rest position.

29. The steering tool of claim 28, wherein said sprung members are deployed substantially equi-angularly about a periphery of said tool body.

30. The steering tool of claim 28, wherein each of said sprung members is operably engaged with a corresponding separate actuation module.

31. A steerable drilling assembly for use in drilling a well bore, said drilling assembly comprising;

a drill string having proximate and distal ends;

a drill bit coupled to the distal end of said drill string; and a steering tool included in said drill string;

said steering tool including:

a tool body having an outer surface;

at least one elongated sprung member deployed on said outer surface of said tool body and configured to lie in a rest position substantially parallel to said outer surface;

said sprung member further having at least one movable end, said movable end being movable with respect to said tool body, wherein displacement of said movable end with respect to said tool body causes elastic spring biasing of said sprung member via bending thereof; and an actuation module deployed on said tool body, the actuation module operably engaged with said sprung member, and disposed, upon actuation, to deflect said movable end thereof away from the rest position;

wherein the elastic spring biasing urges said sprung member to return to the rest position upon de-actuation of said actuation module.

32. The steerable drill assembly of claim 31, wherein said sprung member further comprises a fixed end, said fixed end being fixed to the tool body and deployed towards the proximate end of the drill string.

33. The steerable drill assembly of claim 31, wherein said sprung member further comprises a fixed end, said fixed end being fixed to the tool body and deployed towards the distal end of the drill string.

34. The steerable drill assembly of claim 31, wherein said steering tool is included in said drill string at a distance from about 0.5 meters to about 10 meters from said drill bit.

35. A string of downhole tools for use in a well bore, said string of tools comprising a steering tool coupled therein, the steering tool including:

a steering tool body having an outer surface;

at least one elongated sprung member deployed on said outer surface of said tool body and configured to lie in a rest position substantially parallel to said outer surface;

said sprung member further having at least one movable end, said movable end being movable with respect to said tool body, wherein displacement of said movable end with respect to said tool body causes elastic spring biasing of said sprung member via bending thereof; and an actuation module deployed on said tool body, the actuation module operably engaged with said sprung member, and disposed, upon actuation, to deflect said movable end thereof away from the rest position;

wherein the elastic spring biasing urges said sprung member to return to the rest position upon de-actuation of said actuation module.

36. The string of tools of claim 35, in which the string of tools further comprises at least one measurement-while-drilling tool from the group consisting of:

(a) a sonic formation measurement tool;

(b) a radioactive formation measurement tool;

(c) an electromagnetic wave formation measurement tool; and (d) a drilling formation testing and sampling tool.

37. A method for deflecting a downhole tool eccentrically from the cylindrical axis of a well bore, said method comprising:

(a) providing a downhole tool including a steering tool body having an outer surface; at least one elongated sprung member deployed on the outer surface of the tool body and configured to lie in a rest position substantially parallel to the outer surface; each sprung member further having at least one movable end, the movable end being movable with respect to the tool body, wherein displacement of the movable end with respect to the tool body causes elastic spring biasing of the sprung member via bending thereof, the downhole tool further including an actuation module deployed on the tool body, the actuation module operably engaged with the sprung member;

(b) actuating the actuation module to deflect the movable end of the sprung member away from the rest position, thereby causing a portion of the sprung member to engage the wall of the well bore; and (c) de-actuating the actuation module so as to allow the elastic spring biasing to urge the sprung member to return towards the rest position and away from the wall of the well bore.

38. A method for changing the drilling direction of a drilling assembly in a well bore, said method comprising:

(a) providing a steering tool in the drilling assembly, the steering tool including a tool body having an outer surface; at least one elongated sprung member deployed on the outer surface of the tool body and configured to lie in a rest position substantially parallel to the outer surface; each sprung member further having at least one movable end, the movable end being movable with respect to the tool body, wherein displacement of the movable end with respect to the tool body causes elastic spring biasing of the sprung member via bending thereof, the steering tool further including an actuation module deployed on the tool body, the actuation module operably engaged with the sprung member, (b) actuating the actuation module to deflect the movable end of the sprung member away from the rest position, thereby deflecting the sprung member into engagement with a wall of the well bore, wherein said engagement with the wall of the well bore alters the eccentricity of the steering tool from a cylindrical axis of the well bore, said altering of the eccentricity tending to alter an angle of approach of a drill bit included in the drilling assembly; and (c) de-actuating the actuation module so as to allow the elastic spring biasing to urge the sprung member to return to the rest position and away from the wall of the well bore, wherein said return to the rest position also alters the eccentricity of the steering tool from the cylindrical axis of the well bore.

* * * * *